US009280958B2

(12) United States Patent
Jones

(10) Patent No.: US 9,280,958 B2
(45) Date of Patent: Mar. 8, 2016

(54) ADAPTOR FOR DRUM

(71) Applicant: Keith Jones, Rancho Cucamonga, CA (US)

(72) Inventor: Keith Jones, Rancho Cucamonga, CA (US)

( * ) Notice: Subject to any disclaimer, the term of this patent is extended or adjusted under 35 U.S.C. 154(b) by 0 days.

(21) Appl. No.: 14/821,472

(22) Filed: Aug. 7, 2015

(65) Prior Publication Data

US 2015/0348522 A1 Dec. 3, 2015

Related U.S. Application Data

(63) Continuation of application No. 14/161,130, filed on Jan. 22, 2014, now Pat. No. 9,135,899.

(60) Provisional application No. 61/849,597, filed on Jan. 30, 2013.

(51) Int. Cl.
*G10D 13/02* (2006.01)

(52) U.S. Cl.
CPC ..... *G10D 13/027* (2013.01); *G10D 13/022* (2013.01)

(58) Field of Classification Search
CPC ..... G10D 13/022
See application file for complete search history.

(56) References Cited

U.S. PATENT DOCUMENTS

| | | | | | |
|---|---|---|---|---|---|
| 2,078,004 | A * | 4/1937 | Lebow | G10D 13/022 | 84/411 M |
| 4,154,137 | A * | 5/1979 | Kobayashi | G10D 13/022 | 84/411 R |
| 4,325,281 | A * | 4/1982 | Hardy | G10D 13/022 | 84/411 M |
| 4,466,596 | A * | 8/1984 | Cohen | G10G 5/00 | 248/231.41 |
| 4,567,807 | A * | 2/1986 | Robinson | G10D 13/022 | 84/411 M |
| 4,671,158 | A * | 6/1987 | Saputo | G10D 13/022 | 84/411 M |
| 4,811,405 | A * | 3/1989 | Peiker | H04R 1/08 | 381/365 |
| 4,899,635 | A * | 2/1990 | Santangelo | G10D 13/022 | 84/411 M |
| 5,877,440 | A * | 3/1999 | Chaffee | G10D 13/022 | 84/411 M |
| 5,892,168 | A * | 4/1999 | Donohoe | G10D 13/022 | 84/411 M |
| 6,291,754 | B1 * | 9/2001 | Gatzen | G10D 13/022 | 84/411 M |
| 6,307,133 | B1 * | 10/2001 | May | G10D 13/022 | 181/161 |
| 6,502,793 | B1 * | 1/2003 | Sargent | F16M 13/02 | 248/176.1 |
| 6,644,614 | B1 * | 11/2003 | Chen | F16M 13/02 | 248/229.1 |

(Continued)

FOREIGN PATENT DOCUMENTS

DE 29518362 U1 3/1997

OTHER PUBLICATIONS

"The Rogers Book", Coo R., Second Edition, Nov. 1999, p. 223, Rebeats Publications, Alma, USA.

(Continued)

*Primary Examiner* — Robert W Horn
(74) *Attorney, Agent, or Firm* — Blair Walker IP Services, LLC

(57) ABSTRACT

An adaptor for coupling to a drum having a drum head, shell, and rim, the rim having an outer diameter and configured to interface with a ring coupled to the drum head to hold the drum head in place on the shell, includes a monolithic body having a clip portion and an interface, the clip portion configured to extend around an outer section of the rim between a top surface of the drum head and a bottom portion of the rim, the clip portion having a clip end and the ring having an outer diameter, wherein the clip end is configured to extend to a position that is inward of the outer diameter of the ring when the clip portion is coupled to the drum; and wherein a substantial portion of the interface is configured to extend radially from the rim when the clip portion is coupled to the drum.

20 Claims, 2 Drawing Sheets

(56) References Cited

U.S. PATENT DOCUMENTS 6,696,630 B2 * 2/2004 Gatzen ..... G10D 13/022 84/273
6,757,400 B1 * 6/2004 Cheng ..... H04R 1/08 381/361
7,723,596 B2 * 5/2010 Kelly ..... H04R 1/083 84/421
8,410,345 B2 * 4/2013 Patrick ..... G10D 13/022 84/411 M
8,541,675 B2 * 9/2013 Strickland ..... G10D 13/022 84/411 M
8,962,962 B2 * 2/2015 Jones ..... G10D 13/021 84/411 R
9,135,899 B2 * 9/2015 Jones ..... G10D 13/027
2003/0233928 A1 * 12/2003 Gatzen ..... G10D 13/022 84/411 M
2006/0065099 A1 * 3/2006 Anderson ..... G10D 13/06 84/411 M
2008/0054153 A1 * 3/2008 Soehnholz ..... H04R 1/08 248/645
2008/0264233 A1 * 10/2008 Gatzen ..... G10D 13/022 84/411 M
2015/0348522 A1 * 12/2015 Jones ..... G10D 13/027 84/415

OTHER PUBLICATIONS

"MZH 604", url: en-de.sennheiser.com/mzh-604, dowloaded from internet Sep. 21, 2015.

* cited by examiner

ADAPTOR FOR DRUM

CROSS-REFERENCE TO THE RELATED APPLICATIONS

This application is a continuation of the U.S. patent application Ser. No. 14/161,130, filed on Jan. 22, 2014 which is incorporated herein by reference in its entirety, which claims the benefit of priority to U.S. Provisional Appl. No. 61,849,597, filed on Jan. 30, 2013, entitled "External Drum Ring Control—EDRC," which is incorporated herein by reference in its entirety.

SUMMARY OF THE INVENTION

It is a major object of the invention to provide improved apparatus as referred to EDRC, for use in stopping the ring that occurs when a drum head has nothing on the outer part of the playing service that makes a ring; ERDC stops this from happening.

For combination with any drum having a side wall, a drum head and drum ring. Assembly that comprises of a solid santoprene adaptor (EDRC) that mounts to the underside of the drum ring and comes up the side and over the top clipping to the drum ring while protruding approximately one inch in to the outer part of the drum head touching the drum head to stop the drum from making a ringing sound.

BRIEF DESCRIPTION OF THE DRAWINGS

FIG. 1 is a schematic side view of a drum that the DrumClip External Drum Ring Control (EDRC) will go on.

DETAILED DESCRIPTION OF THE INVENTION

Figure 1:
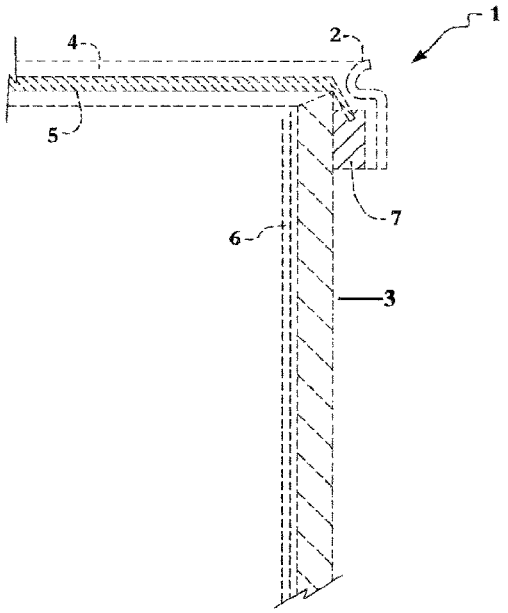
Figure 2:
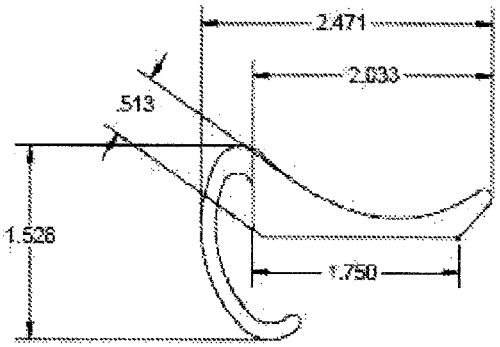
FIG. 2 shows the dimensions of the DrumClip External Drum Ring Control (EDRC) from a side view.
Figure 3:
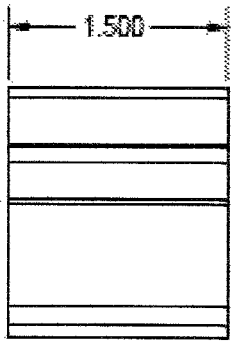
FIG. 3 shows the dimensions of the DrumClip External Drum Ring Control (EDRC) from the back side.
Figure 4:
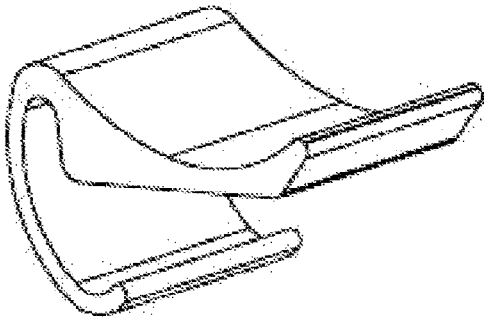
FIG. 4 shows the DrumClip External Drum Ring Control (EDRC) from a front side top view.
Figure 5:
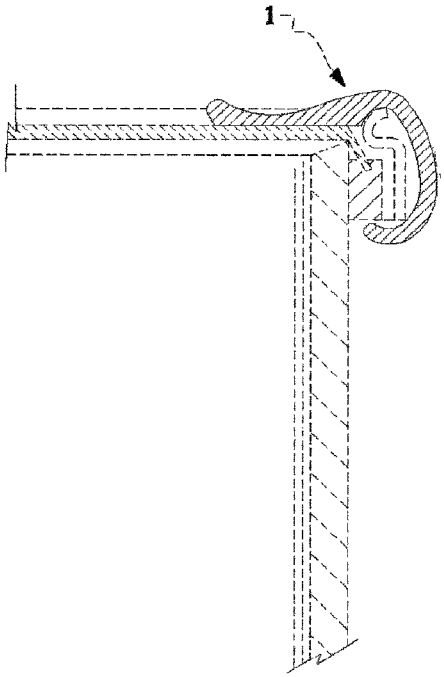
FIG. 5 is a schematic side view of a FIG. 1 that the DrumClip External Drum Ring Control (EDRC) will go on and how it clips on the drum.
Figure 6:
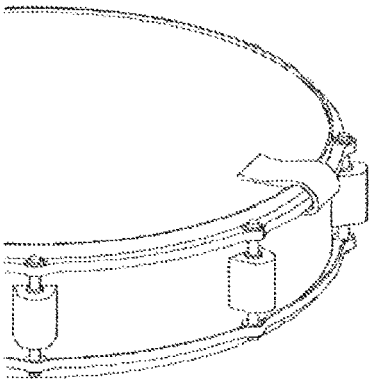
FIG. 6 is a perspective view of the DrumClip External Drum Ring Control (EDRC) on a drum.

FIG. 1 is a schematic side view of a drum 1 that the DrumClip External Drum Ring Control (EDRC) will go on. The drum 6 & 3 a shell typically wooden and a drum head 5 at one open end of the shell, for example the top end (Batter Head). An aluminum ring 7 is connected to the drum head 5 to extend on and about the shell. The drum rim 2 is the edge of the drum rim and 4 is the side rim (typically made of metal) holding the drum head 5 & 7 in place and to put desired tension on the drum head 5 & 7.

For combination with any drum having a side wall, a drum head and drum ring. Assembly that comprises of a solid santoprene adaptor (EDRC) that mounts to the underside of the drum ring and comes up the side over the top clipping to the drum ring while protruding approximately one inch in to the outer part of the drum head touching the drum head to stop the drum from making a ringing sound.

This invention external drum ring control relates generally to drumming apparatus, and more particularly to improvements to auxiliary apparatus attachable to any drum, such as a snare drum, in respect of putting pressure on the outer part of the drum head to produce a more desired acoustic sound and taking away the ring that occurs when the outer part of the drum head has nothing on it to control the ring the drum makes when played.

It is a major object of the invention to provide improved apparatus as referred to, for use in stopping the ring that occurs when a drum head has nothing on the outer part of the playing service that makes a ring; ERDC stops this from happening.

The advantages of this invention, as well as the details of an illustrative embodiment, will be more fully understood from the following specification and drawings.

That apparatus basically comprises of a solid santoprene made adaptor that hooks under any drum ring then comes up over the drum ring clipping on the ring while touching the drum head to stop the ringing.

What is claimed is:

1. An adaptor for coupling to a drum having a drum head, a shell, and a rim, the rim having an outer diameter and configured to interface with a ring coupled to the drum head to hold the drum head in place on the shell, the adaptor comprising:

a monolithic body having a clip portion and an interface, the clip portion configured to extend around an outer section of the rim between a top surface of the drum head and a bottom portion of the rim, the clip portion having a clip end and the ring having an outer diameter, wherein the clip end is configured to extend to a position that is inward of the outer diameter of the ring when the clip portion is coupled to the drum; and wherein a substantial portion of the interface is configured to extend radially from the rim when the clip portion is coupled to the drum.

2. The adaptor of claim 1, wherein the monolithic body comprises santoprene.

3. The adaptor of claim 1, wherein the drum is a snare drum.

4. The adaptor of claim 1, wherein the interface has a generally rectangular shape.

5. The adaptor of claim 1, wherein the interface is defined by a first dimension extending from the rim when the clip portion is coupled to the drum and a second dimension transverse to the first dimension, and wherein the first dimension is greater than the second dimension.

6. The adaptor of claim 1, wherein the interface is configured to apply a pressure to a portion of the top surface of the drum head when the clip portion is coupled to the drum.

7. The adaptor of claim 6, wherein drum head has an outer diameter, and wherein a portion of the interface is configured to apply pressure to the top surface of the drum head at a point approximately one inch inward from the outer diameter of the drum head.

8. The adaptor of claim 7, wherein the outer diameter of the drum head is not equal to the outer diameter of the ring.

9. The adaptor of claim 6, wherein the interface includes a planar surface configured to contact the top surface of the drum head.

10. A drum comprising:

a shell;

a rim having an outer diameter and configured to hold a drum head to the shell at a desired tension, wherein the drum head includes a ring having an outer diameter;

an attachable adaptor having a monolithic structure and including a clip portion and an interface, the clip portion configured to extend around an outer section of the rim between a top surface of the drum head and a bottom portion of the rim, the clip portion having a clip end and the ring having an outer diameter, wherein the clip end is configured to extend to a position that is inward of the outer diameter of the ring when the clip portion is clipped in place relative to the drum head; and wherein a substantial portion of the interface is configured to extend radially from the rim when the clip portion is clipped in place relative to the drum head.

11. The drum of claim 10, wherein the monolithic structure comprises santoprene.

12. The drum of claim 10, wherein the drum is a snare drum.

13. The drum of claim 10, wherein the interface has a generally rectangular shape.

14. The drum of claim 10, wherein the interface is defined by a first dimension extending from the rim when the clip portion is clipped in place relative to the drum head and a second dimension transverse to the first dimension, and wherein the first dimension is greater than the second dimension.

15. The drum of claim 10, wherein the drum exhibits increased acoustic ringing when the attachable adaptor is not clipped in place relative to the drum head.

16. The drum of claim 10, wherein the shell comprises wood and the rim comprises a metal.

17. The drum of claim 10, wherein the interface is configured to apply a pressure to a portion of the top surface of the drum head when the clip portion is clipped in place relative to the drum head.

18. The drum of claim 17, wherein drum head has an outer diameter, and wherein a portion of the interface is configured to apply pressure to the top surface of the drum head at a point approximately one inch inward from the outer diameter of the drum head.

19. The drum of claim 18, wherein the outer diameter of the drum head is not equal to the outer diameter of the ring.

20. The drum of claim 17, wherein the interface includes a planar surface configured to contact the top surface of the drum head.

* * * * *